US011280553B2

(12) United States Patent
Choi et al.

(10) Patent No.: US 11,280,553 B2
(45) Date of Patent: Mar. 22, 2022

(54) HEAT EXCHANGE APPARATUS

(71) Applicant: LG Electronics Inc., Seoul (KR)

(72) Inventors: Jaeheuk Choi, Seoul (KR); Kyungrock Kim, Seoul (KR); Byoungjin Ryu, Seoul (KR)

(73) Assignee: LG Electronics Inc., Seoul (KR)

( * ) Notice: Subject to any disclaimer, the term of this patent is extended or adjusted under 35 U.S.C. 154(b) by 41 days.

(21) Appl. No.: 16/626,757

(22) PCT Filed: Jun. 25, 2018

(86) PCT No.: PCT/KR2018/007181
§ 371 (c)(1),
(2) Date: Dec. 26, 2019

(87) PCT Pub. No.: WO2019/004681
PCT Pub. Date: Jan. 3, 2019

(65) Prior Publication Data

US 2020/0132385 A1 Apr. 30, 2020

(30) Foreign Application Priority Data

Jun. 26, 2017 (KR) ..... 10-2017-0080669

(51) Int. Cl.
*F28D 7/10* (2006.01)
*F28D 7/16* (2006.01)
*F25B 39/02* (2006.01)

(52) U.S. Cl.
CPC ..... *F28D 7/16* (2013.01); *F25B 39/02* (2013.01)

(58) Field of Classification Search
CPC ..... F28D 7/16; F28B 39/02
USPC ..... 165/154
See application file for complete search history.

(56) References Cited

U.S. PATENT DOCUMENTS

2006/0096314 A1* 5/2006 Nakamura ..... F16L 9/18 62/498
2008/0251241 A1* 10/2008 Yusa ..... F28F 1/08 165/154
2012/0240920 A1* 9/2012 Rhodes ..... F28D 7/16 126/643
2014/0000850 A1* 1/2014 Korn ..... F28D 21/0003 165/104.19

* cited by examiner

*Primary Examiner* — Davis D Hwu
(74) *Attorney, Agent, or Firm* — Fish & Richardson P.C.

(57) ABSTRACT

The present invention relates to a heat exchanger. The heat exchanger according to the present invention includes: an outer pipe; a first sub heat exchange part and a second sub heat exchange part which are disposed inside the outer pipe, and in which a second fluid flows around a first fluid pipe through which a first fluid flows; and a main heat exchange part which is disposed, inside the outer pipe, between the first sub heat exchange part and the second sub heat exchange part, and in which the first fluid flows around a plurality of narrow pipes through which the second fluid flows.

7 Claims, 11 Drawing Sheets

HEAT EXCHANGE APPARATUS

CROSS-REFERENCE TO RELATED APPLICATIONS

This application is a National Stage application under 35 U.S.C. § 371 of International Application No. PCT/KR2018/007181, filed Jun. 25, 2018, which claims the benefit of Korean Application No. 10-2017-0080669, filed on Jun. 26, 2017. The disclosures of the prior applications are incorporated by reference in their entirety.

TECHNICAL FIELD

The present invention relates to a heat exchanger, and more particularly, to a heat exchanger disposed in a refrigeration system using an indoor unit as a showcase.

BACKGROUND ART

A refrigeration system is configured to achieve refrigeration or freezing of foods or the like in a certain space by a heat exchange between the refrigerant flowing through a heat exchange cycle and the outdoor air, and a heat exchange between refrigerant and the certain space.

The refrigeration system includes a compressor for compressing a refrigerant, an outdoor heat exchanger for performing heat exchange between the refrigerant and outdoor air, an expansion unit for depressurizing the refrigerant condensed in the outdoor heat exchanger, and an evaporator for evaporating the expanded refrigerant.

The cold air generated in the evaporator cools a certain space, and this certain space may be a space used as a showcase used in a supermarket or a convenience store. The showcase of the supermarket or the convenience store is used all year round, thereby requiring relatively high power consumption.

Accordingly, thermal efficiency can be increased by using a heat exchanger, and the like. When a large amount of heat exchange is achieved in the heat exchanger as much as possible, the power consumption of the showcase can be reduced.

DISCLOSURE

Technical Problem

The present invention has been made in view of the above problems, and provides a heat exchanger in which a plurality of heat exchange is achieved in a single unit.

The present invention further provides a heat exchanger having a high heat exchange rate between the fluid flowing inside.

The objects of the present invention are not limited to the above-mentioned objects, and other objects not mentioned will be clearly understood by those skilled in the art from the following description.

TECHNICAL SOLUTION

A heat exchanger in accordance with an aspect of the present invention includes: an outer pipe; a first sub heat exchange part and a second sub heat exchange part which are disposed inside the outer pipe, and in which a second fluid flows around a first fluid pipe through which a first fluid flows; and a main heat exchange part which is disposed, inside the outer pipe, between the first sub heat exchange part and the second sub heat exchange part, and in which the first fluid flows around a plurality of narrow pipes through which the second fluid flows, thereby achieving heat exchange in three areas inside the heat exchanger.

The heat exchanger in accordance with an aspect of the present invention further includes: a first inner fixing plate partitioning the first sub heat exchange part and the main heat exchange part; and a second inner fixing plate partitioning the main heat exchange part and the second sub heat exchange part, thereby partitioning the first sub heat exchange part, the main heat exchange part, and the second sub heat exchange part.

In the heat exchanger in accordance with an aspect of the present invention, the first inner fixing plate and the second inner fixing plate fix the plurality of narrow pipes, and the plurality of narrow pipes have one end that is opened toward the first sub heat exchange part, and the other end that is opened toward the second sub heat exchange part, so that the main heat exchange unit performs a heat exchange through a plurality of narrow pipes.

In the heat exchanger in accordance with an aspect of the present invention, the first inner fixing plate fixes the first fluid pipe disposed in the first sub heat exchange part, the second inner fixing plate fixes the first fluid pipe disposed in the second sub heat exchange part, and each of the first fluid pipe fixed to the first inner fixing plate and the second fluid pipe fixed to the second inner fixing plate is opened toward the main heat exchange part, so that the first and second sub-heat exchangers perform heat exchange through the first fluid pipe.

In the heat exchanger in accordance with an aspect of the present invention, in the first sub heat exchange part, the first fluid passed through the main heat exchange part flows to the first fluid pipe disposed in the first sub heat exchange part, and the second fluid introduced into an inflow hole formed in one side of the outer pipe flows around the first fluid pipe, thereby achieving the heat exchange inside the first sub heat exchanger.

In the main heat exchange part of the heat exchanger in accordance with an aspect of the present invention, a plurality of narrow pipes through which the second fluid flows are disposed inside the outer pipe, and the first fluid introduced into the first fluid pipe flows around the plurality of narrow pipes, thereby achieving heat exchange in the main heat exchange part.

A heat exchanger in accordance with another aspect of the present invention includes an outer pipe which has an inflow hole through which a second fluid flowing a second fluid pipe is introduced, a discharge hole through which the second fluid is discharged, and a space in which a first fluid and the second fluid exchange heat; a first fluid pipe which partly disposed inside the outer pipe and through which the first fluid flows; a plurality of narrow pipes which are disposed inside the outer pipe and allow the second fluid introduced into the inflow hole of the outer pipe to flow; and an inner fixing plate that partitions a space in which the first fluid pipe and the plurality of narrow pipes are disposed, wherein the first fluid pipe and the plurality of narrow pipes fixed to the inner fixing plate are opened in different directions, so that heat exchange may occur around the plurality of narrow pipes and around the first fluid pipe.

The outer pipe in accordance with another aspect of the present invention has a shape in which both ends are opened, and the first fluid pipe is inserted into the outer pipe through the opened both ends of the outer pipe, and the both ends of the outer pipe has an end fixing plate for sealing between the opened both ends of the outer pipe and the first fluid pipe, thereby sealing between the outer pipe and the first fluid pipe.

The outer pipe in accordance with another aspect of the present invention includes an inflow nozzle which is connected to the second fluid pipe having a circumferential surface on which the second fluid flows, and has an inflow hole through which the second fluid flows into the outer pipe; and a discharge nozzle which is connected to the second fluid pipe through which the second fluid flows, and has a discharge hole that discharges the second fluid inside the outer pipe, thereby flowing the second fluid into the outer pipe.

The first fluid pipe in accordance with another aspect of the present invention maintains a straight pipe shape when connected to the outer shape, and the second fluid pipe has a bent shape when connected to the inflow nozzle or the discharge nozzle, thereby reducing the pressure loss that can occur in the first fluid pipe.

In the heat exchanger in accordance with another aspect of the present invention, a ratio of a cross-sectional area due to an inner diameter of the second fluid pipe through which the second fluid flows and a total cross-sectional area according to an inner diameter of the plurality of narrow pipes is 0.05 to 0.4.

Specific details of other embodiments are included in the detailed description and the drawings.

Advantageous Effects

According to the heat exchanger of the present invention has one or more of the following effects.

First, the heat exchanger according to the present invention has an advantage of increasing heat efficiency of the heat exchanger by performing heat exchange in a portion into which the second fluid is introduced or to which the second fluid is discharged around the main heat exchanger.

Second, the heat exchanger according to the present invention has an advantage of reducing power consumption by using a heat exchanger having a high heat-efficiency in which heat exchange is performed in three areas including the first sub heat exchange part, the second sub heat exchange part, and the main heat exchange part, inside the outer pipe.

Third, the heat exchanger according to the present invention has an advantage of reducing the pressure loss of the first fluid flowing into the first fluid pipe by implementing the first fluid pipe to be straight.

The effects of the present invention are not limited to the above-mentioned effects, and other effects not mentioned will be clearly understood by those skilled in the art from the description of the claims.

MODE FOR INVENTION

Figure 1:
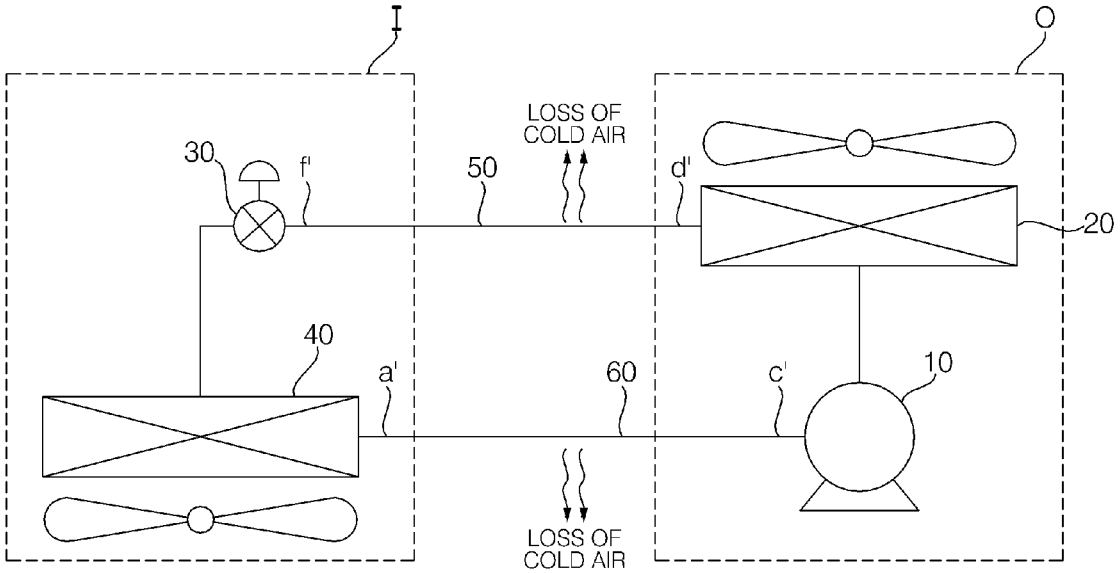
FIG. 1 is a schematic diagram illustrating a refrigeration system in which a heat exchanger is not installed.

Hereinafter, preferred embodiments of the present invention will be described with reference to the accompanying drawings. In describing the present embodiment, the same designations and the same reference numerals are used for the same components, and further description thereof will be omitted.

Hereinafter, the present invention will be described with reference to the drawings for describing a refrigeration system according to embodiments of the present invention.

Figure 2:
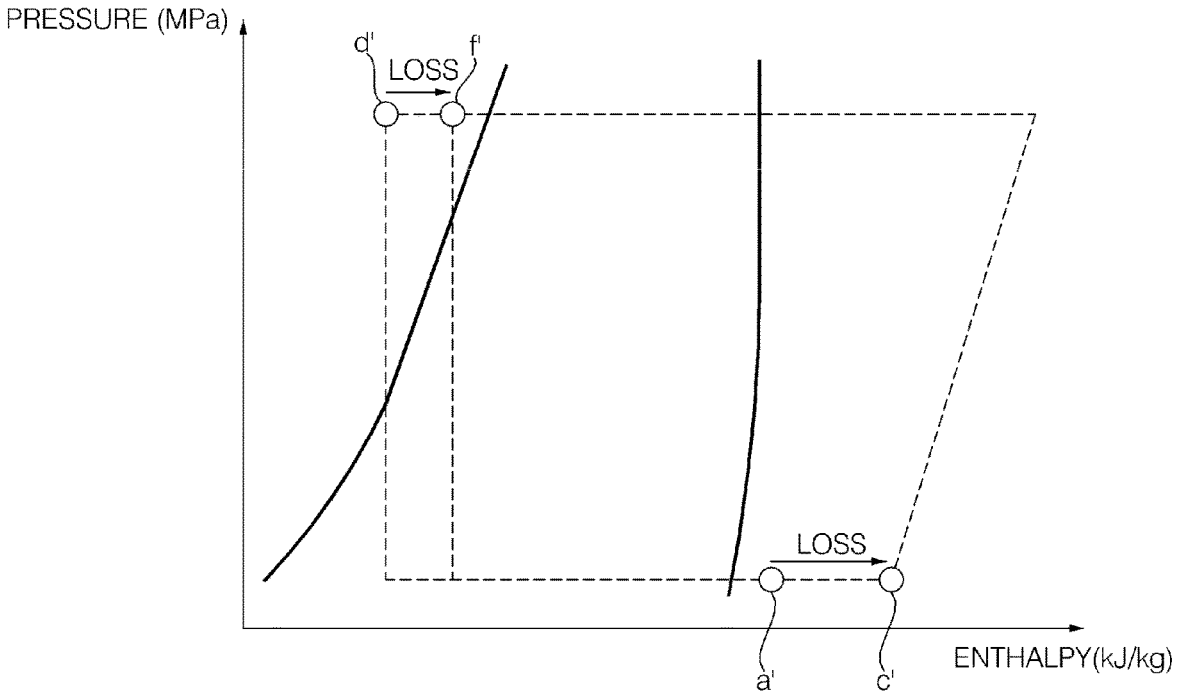
FIG. 2 is a Moliere diagram of the refrigeration system of FIG. 1.
Figure 3:
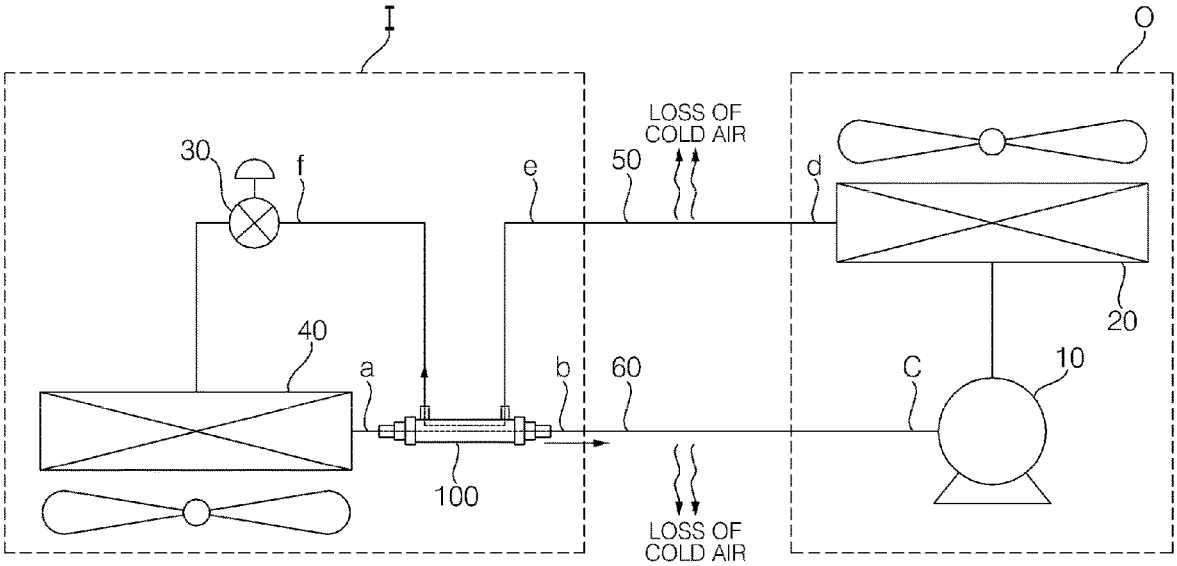
FIG. 3 is a schematic diagram illustrating a refrigeration system provided with a heat exchanger according to an embodiment of the present invention.
Figure 4:
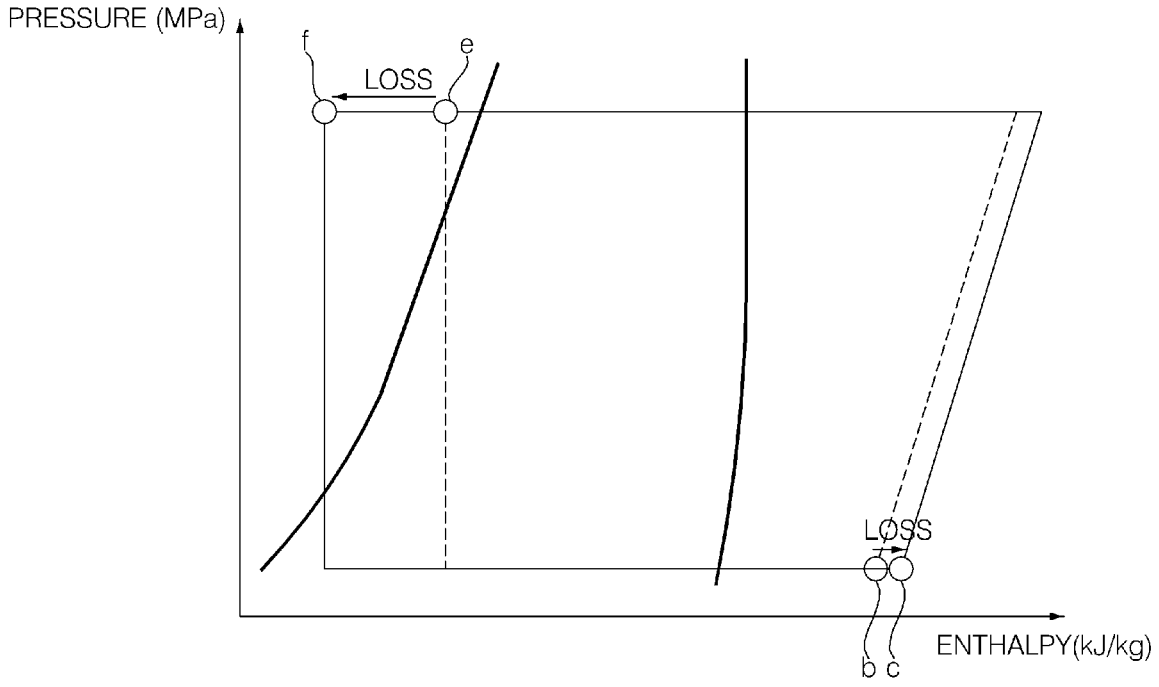
FIG. 4 is a Moliere diagram of the refrigeration system of FIG. 3.
Figure 5:
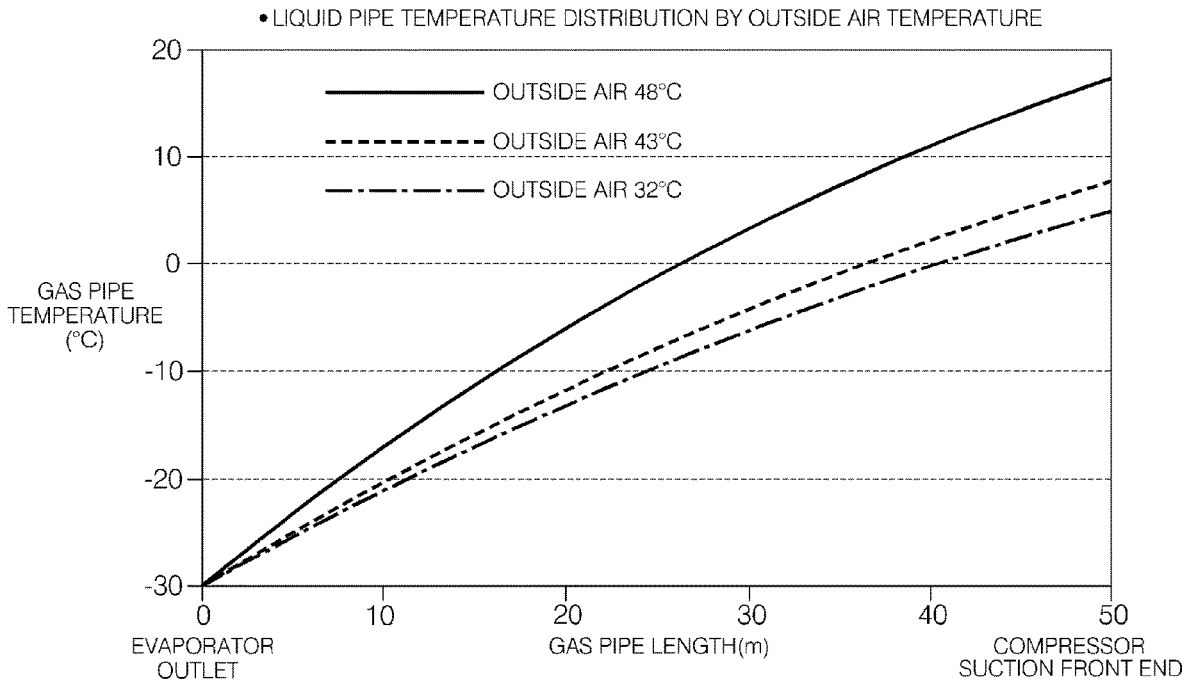
FIG. 5 is a temperature distribution table of a refrigerant discharged from an evaporator and flowing through a gas pipe installed outside an indoor unit.
Figure 6:
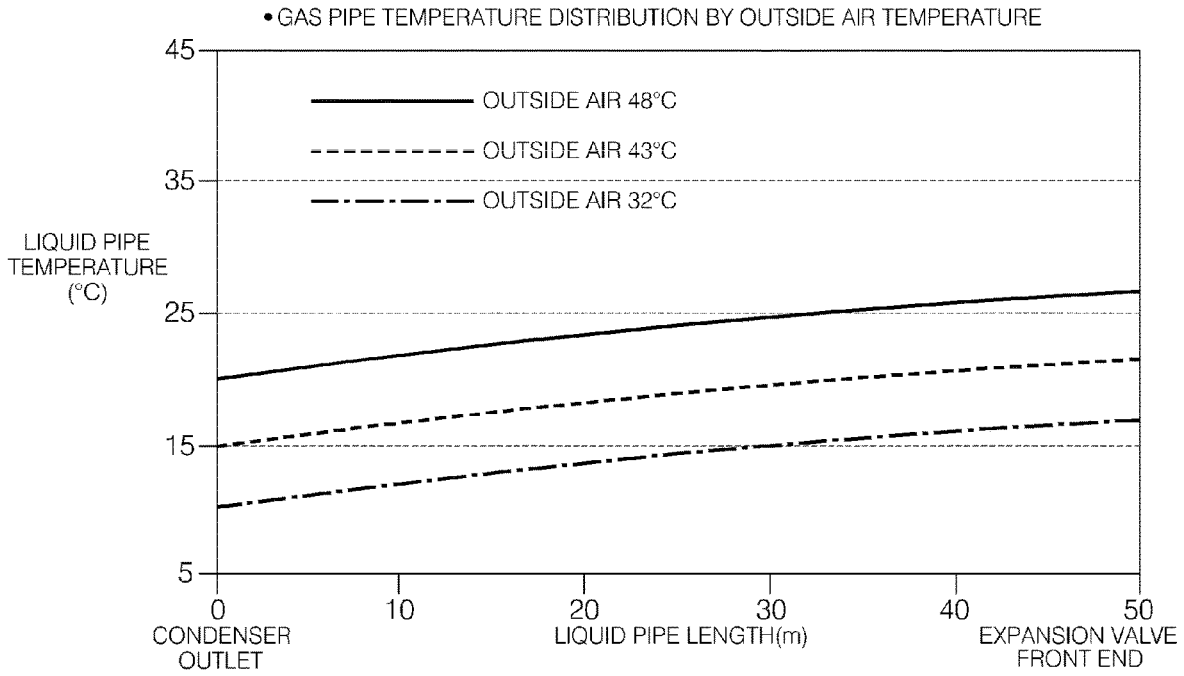
FIG. 6 is a temperature distribution table of a refrigerant flowing in a liquid pipe installed outside the outdoor unit as the refrigerant of FIG. 5 flows and is discharged from a condenser.
Figure 7:
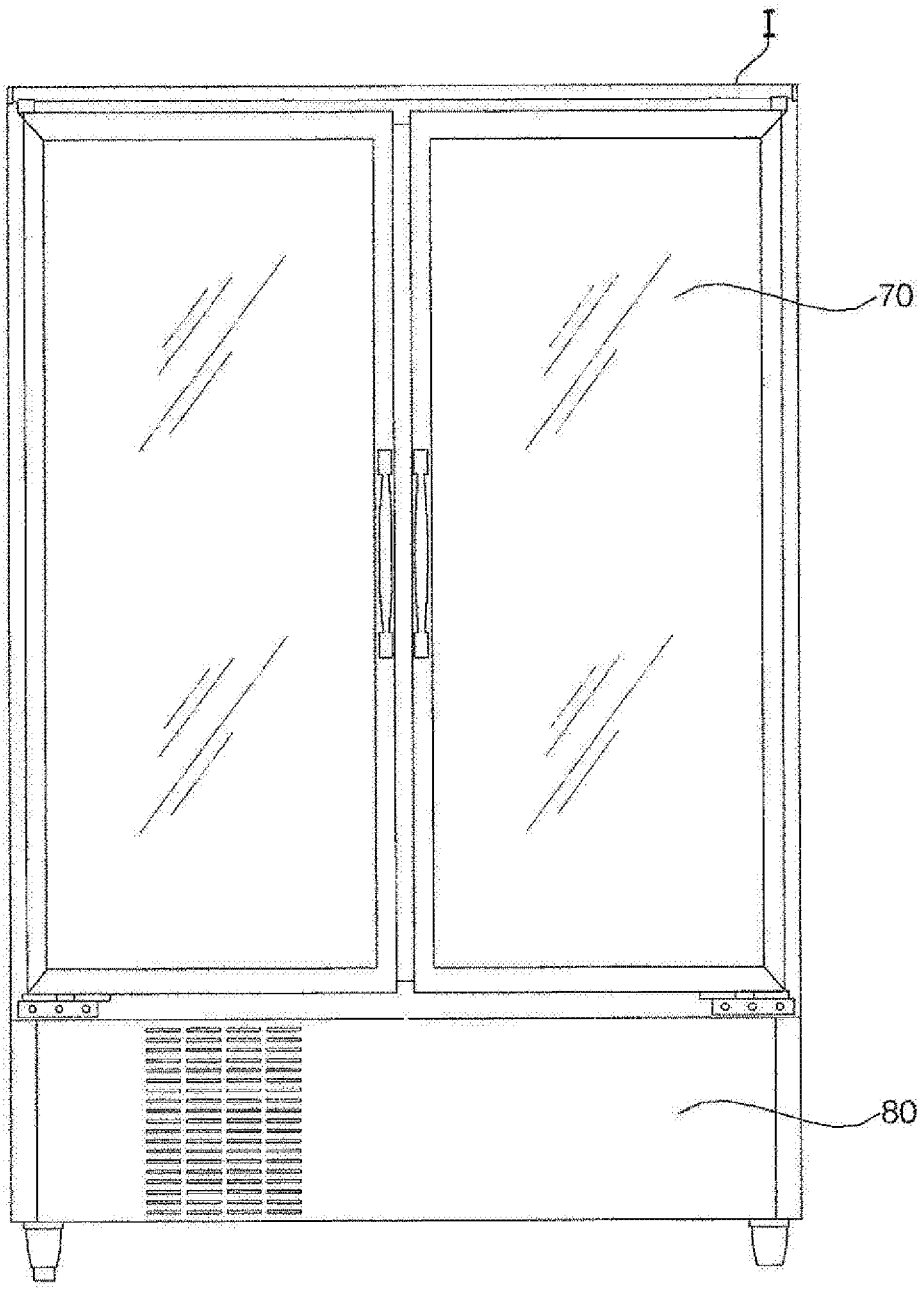
FIG. 7 is a diagram illustrating a showcase according to an embodiment of the present invention.
Figure 8:
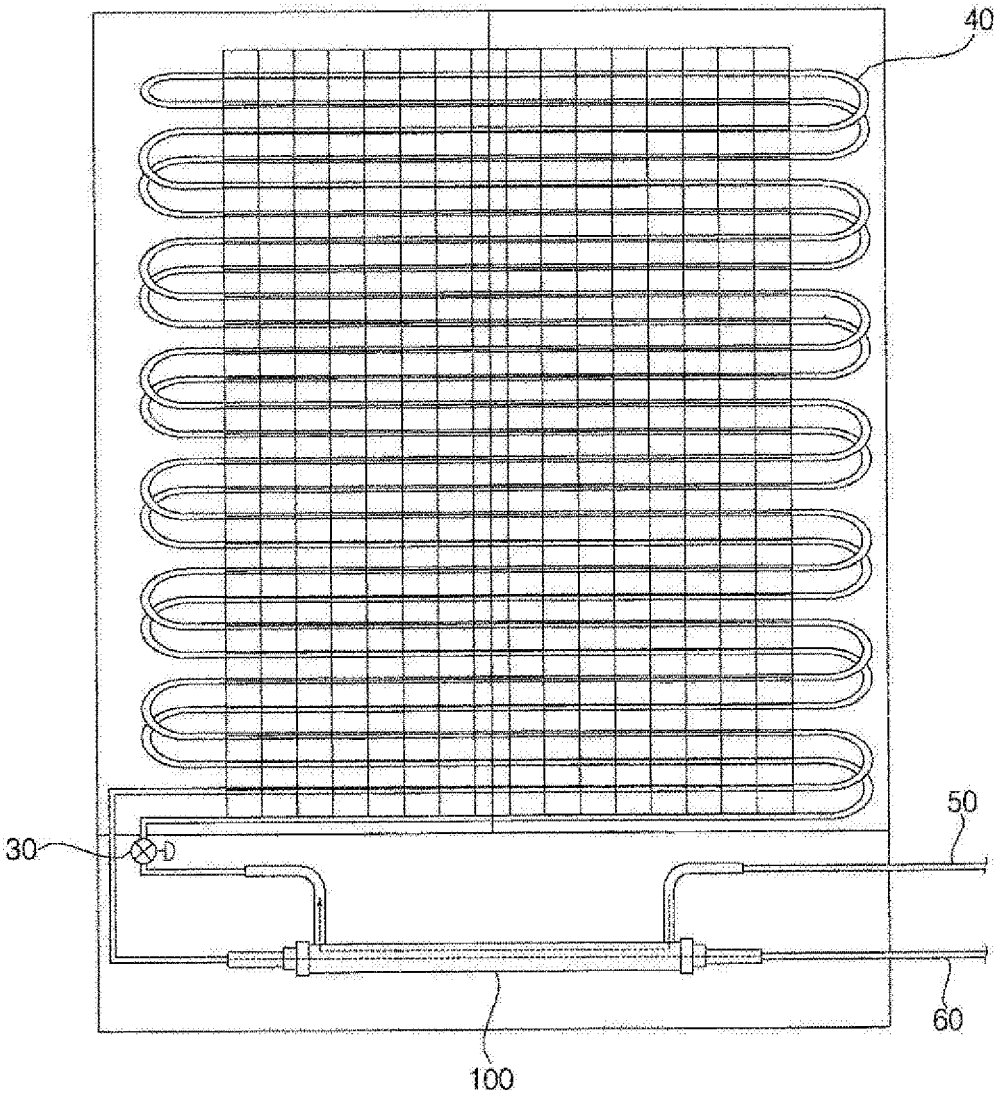
FIG. 8 is a diagram illustrating a configuration of a refrigeration system disposed inside the showcase of FIG. 7.

FIG. 1 is a schematic diagram illustrating a refrigeration system in which a heat exchanger is not installed. FIG. 2 is a Moliere diagram of the refrigeration system of FIG. 1. FIG. 3 is a schematic diagram illustrating a refrigeration system provided with a heat exchanger according to an embodiment of the present invention. FIG. 4 is a Moliere diagram of the refrigeration system of FIG. 3. FIG. 5 is a temperature distribution table of a refrigerant discharged from an evaporator and flowing through equipment installed outside an indoor unit. FIG. 6 is a temperature distribution table of a refrigerant flowing in a liquid pipe installed outside the outdoor unit as the refrigerant of FIG. 5 flows and is discharged from a condenser. FIG. 7 is a diagram illustrating a showcase according to an embodiment of the present invention. FIG. 8 is a diagram illustrating a configuration of a refrigeration system disposed inside the showcase of FIG. 7.

The refrigeration system according to the present embodiment includes a compressor 10 for compressing a refrigerant, a condenser 20 for condensing the refrigerant compressed in the compressor 10, an expansion valve 30 for expanding the refrigerant condensed in the condenser 20, and an evaporator 40 for evaporating the refrigerant expanded by the expansion valve 30. The refrigeration system according to the present embodiment includes a liquid pipe 50 for flowing the refrigerant condensed through the condenser 20 to the expansion valve 30, and a gas pipe 60 for flowing the refrigerant evaporated through the evaporator 40 to the compressor 10. The refrigeration system according to the present embodiment further includes a heat exchanger 100 for exchanging heat between the refrigerant flowing through the liquid pipe 50 and the refrigerant flowing through the gas pipe 60.

In the refrigeration system according to the present embodiment, the expansion valve 30 for expanding the refrigerant condensed in the condenser 20 and the evaporator 40 for evaporating the refrigerant expanded by the expansion valve are disposed inside an indoor unit I, and a compressor for compressing the refrigerant and the condenser 20 for condensing the refrigerant compressed by the compressor 10 are disposed in an outdoor unit O. The heat exchanger 100 according to the present embodiment may be disposed inside the indoor unit I.

The refrigeration system according to the present embodiment may use a showcase I of FIG. 8 as the indoor unit I. In the refrigeration system according to the present embodiment using the indoor unit I as the showcase I, the distance between the outdoor unit O and the indoor unit I may be spaced by a considerable distance. In the case of a showcase, it may be an apparatus installed in a store, such as a supermarket or a large convenience store, which handles foods, and is installed in order to maintain cooling (refrigerate) while keeping goods in low temperature, or to display goods in a frozen state.

The showcase according to the present embodiment may be disposed in an indoor space, and the outdoor unit including the compressor and the condenser may be installed in a invisible place to the customer, e.g., an exterior of a building, or installed in a remote place, such as a roof of a building where the indoor unit is installed, from a space in which the indoor unit is disposed.

Therefore, in the refrigeration system according to the present embodiment, since the indoor unit and the outdoor unit are disposed in different spaces, the outdoor unit and the indoor unit are disposed spaced apart by a considerable distance.

In the refrigeration system according to the present embodiment, the liquid pipe 50 and the gas pipe 60, which are a refrigerant pipe for circulating the refrigerant, are connected between the outdoor unit O and the indoor unit I. Since the indoor unit I and the outdoor unit O are disposed in different spaces, the liquid pipe 50 and the gas pipe 60, through which the refrigerant circulating the outdoor unit and the indoor unit flows, are formed with a length that can connect the indoor unit I and the outdoor unit O disposed in different spaces.

The outdoor unit O and the indoor unit I according to the present embodiment may be installed to be spaced apart by 20 m to 50 m. In case, the liquid pipe 50 and the gas pipe 60, through which the refrigerant flowing between the outdoor unit O and the indoor unit I flows, are also formed as a long pipe of 20 m to 50 m respectively. In addition, the outdoor unit O and the indoor unit I according to the present embodiment may be installed to be spaced apart by a distance of 50 m or more. In this case, the length of the gas pipe 60 and the liquid pipe 50 is formed to be 50 m or more.

In the refrigeration system according to the present embodiment, the refrigerant flowing through the liquid pipe 50 and the gas pipe 60 maintains a lower temperature than the outdoor temperature. In the case of using a R410A refrigerant in the refrigerating system according to the present embodiment, the liquid refrigerant discharged from the condenser 20 may be formed approximately at a temperature of 10° C., and the gaseous phase refrigerant discharged from the evaporator 40 may be formed approximately at a temperature of −30° C.

In the refrigeration system according to the present embodiment, since the showcase, which is the indoor unit I, and the outdoor unit O are disposed spaced apart by a considerable distance, a large amount of cold air is lost during the flow of the refrigerant discharged from the condenser 20 through the liquid pipe 50. In the process in which the refrigerant discharged from the evaporator 40 flows the gas pipe 60, a considerable amount of cold air is lost.

In particular, in the case of a refrigeration system in the summer, or disposed in an area having outdoor temperature above 30° C., like a high temperature region, the refrigerant flowing through the liquid pipe and the gas pipe loses the cold air during the flow process. When the refrigerant flowing through the liquid pipe 50 and the gas pipe 60 loses the cold air, the loss of the freezing capacity due to the temperature rise of the refrigerant flowing into the condenser 20, and the loss of the freezing capacity due to the temperature rise of the refrigerant flowing into the evaporator 40 occur.

Referring to the gas pipe temperature distribution table according to the outside air temperature of FIG. 5, it can be seen that as the length of the gas pipe 60 becomes longer in the state where the temperature of the outside air is 30° C. or more, the temperature of the gaseous phase refrigerant flowing inside the gas pipe rises. That is, the temperature of the gaseous phase refrigerant rises above 20° C. for 20 m or more, and the temperature of the gaseous phase refrigerant rises above 30° C. for 50 m or more. Such a temperature rise of the refrigerant flowing into the compressor causes a loss of the freezing capacity of the refrigeration system.

Referring to FIG. 6, the liquid pipe temperature distribution table according to the outside temperature, it can be seen that in the state where the temperature of the outside air is 30° C. or more, the temperature of the liquid refrigerant discharged from the condenser rises to about 3° C. while the liquid refrigerant passes through the liquid pipe formed in a length of 20 m or more, and the temperature of the liquid refrigerant rises to about 7° C. while the liquid refrigerant passes through the liquid pipe formed in a length of 50 m or more. Such a temperature rise of the refrigerant flowing into the expansion valve reduces the supercooling degree of the refrigeration system.

Referring to FIGS. 1 to 2, examining the temperature of the refrigerant flowing through the refrigeration system having no heat exchanger, in the state where the liquid pipe 50 and the gas pipe 60 are formed in a 50 m long pipe, and the condition of the outside air is 32° C., the temperature of the gaseous phase refrigerant discharged from the evaporator 40 is −30° C., but the temperature of the gaseous phase refrigerant that flows into the compressor 10 rises by 35° C. as the cold air is lost due to the external temperature while passing through the gas pipe 60 of 50 m, so that the refrigerant of 5° C. flows into the compressor 10. The temperature of the gaseous phase refrigerant rises by about 35° C. due to cold air loss during a process of passing through the gas pipe, so that the temperature flowing into the compressor 10 rises.

In addition, although the temperature of the liquid refrigerant discharged from the condenser 20 is 10° C., the temperature of the liquid refrigerant measured at the inlet of the showcase rises to 16.2° C. as the cold air is lost due to the outside temperature while the liquid refrigerant passes through the liquid pipe 50 of the 50 m long pipe. Therefore, the temperature of the refrigerant discharged from the condenser 20 rises to 6.2° C. and flows into the expansion valve 30.

The refrigeration system according to the present embodiment further includes a heat exchanger 100 for exchanging heat between the refrigerant flowing through the liquid pipe 50 and the refrigerant flowing through the gas pipe 60. The heat exchanger 100 according to the present embodiment may be disposed inside the indoor unit I. In the refrigeration system according to the present embodiment, the liquid refrigerant flowing in the liquid pipe 50 and the gaseous phase refrigerant flowing in the gas pipe 60 exchange heat with each other inside the indoor unit I.

Therefore, the liquid refrigerant, which flows along the liquid pipe 50 disposed between the outdoor unit O and the indoor unit I and whose temperature rises due to the outside air temperature, passes through the heat exchanger 100 disposed inside the showcase I and has a dropped temperature, and then, flows into the evaporator 40 via the expansion valve 30.

Hereinafter, referring to FIGS. 3 to 4, the temperature of the refrigerant flowing through the refrigeration system having a heat exchanger according to the present embodiment is examined. In a state where the liquid pipe and the gas pipe are 50 m long pipes, and the outside air condition is the outdoor air 32° C., the temperature of the refrigerant at a discharge port portion a in the evaporator is formed to be approximately −30° C. The refrigerant discharged from the evaporator 40 passes through the heat exchanger 100 to lose the cold air, and the refrigerant of approximately −2° C. is discharged from a discharge port portion b of the gas pipe 60 of the heat exchanger 100. The refrigerant passed through the heat exchanger 100 and flowing in the gas pipe has an increased temperature by 18° C. during the process of flowing the gas pipe connected to the outdoor unit from the outside of the indoor unit, so that the temperature of the refrigerant at the inlet portion c of the compressor 10 is formed to be approximately 16° C.

The temperature of the refrigerant discharged from the condenser 20 in the discharge port portion d of the condenser 20 is formed to be approximately 10° C. However, while the liquid refrigerant discharged from the condenser 20 passes through the liquid pipe 50 formed to be a length of 50 m, the temperature rises by 6.2° C., so that the refrigerant having a temperature of approximately 16.2° C. flows into the heat exchanger 100 in the inlet portion e of the heat exchanger 100. The liquid refrigerant whose temperature has risen recovers the cold air while passing through the heat exchanger 100 inside the showcase. The temperature of the refrigerant at the inlet portion f of the expansion valve 30 discharged from the heat exchanger 100 and introduced into the expansion valve 30 is formed to be approximately −5° C. The gaseous phase refrigerant passing through the heat exchanger 100 and having the temperature lowered to −5° C. is introduced into the evaporator 40 via the expansion valve 30.

The refrigeration system equipped with the heat exchanger 100 according to the present embodiment increases the supercooling degree of the refrigerant flowing into the expansion valve 30 to increase the refrigeration capacity of the refrigeration system. Meanwhile, the temperature of the refrigerant flowing into the compressor 10 is increased, but this is not significantly different from the temperature rise of the refrigerant generated in the refrigeration system using the gas pipe of the long pipe according to the present embodiment so that the overall refrigeration capacity of the refrigeration system is increased.

The showcase I used as the indoor unit I according to the present embodiment may be divided into a shelf portion 70 in which goods are displayed and cold air is maintained, and a machine room 80 in which the expansion valve and the evaporator are disposed. The showcase I according to the present embodiment may include the heat exchanger 100 in which the liquid refrigerant and the gaseous phase refrigerant exchange heat with each other, and the heat exchanger 100 may be disposed in the machine room 80.

The shelf portion 70 according to the present embodiment may be disposed in the front side of the showcase, and the machine room 80 may be formed in a space behind and below the shelf portion 70. The evaporator 40 according to the present embodiment may be disposed in the rear side of the shelf portion, and the heat exchanger 100 may be disposed in a space formed below the shelf portion 70.

The gas pipe 60 connected to the heat exchanger 100 according to the present embodiment is connected to the heat exchanger 100 in the form of a straight pipe, and the liquid pipe 50 is connected to the heat exchanger 100 in a bent form.

Figure 9:
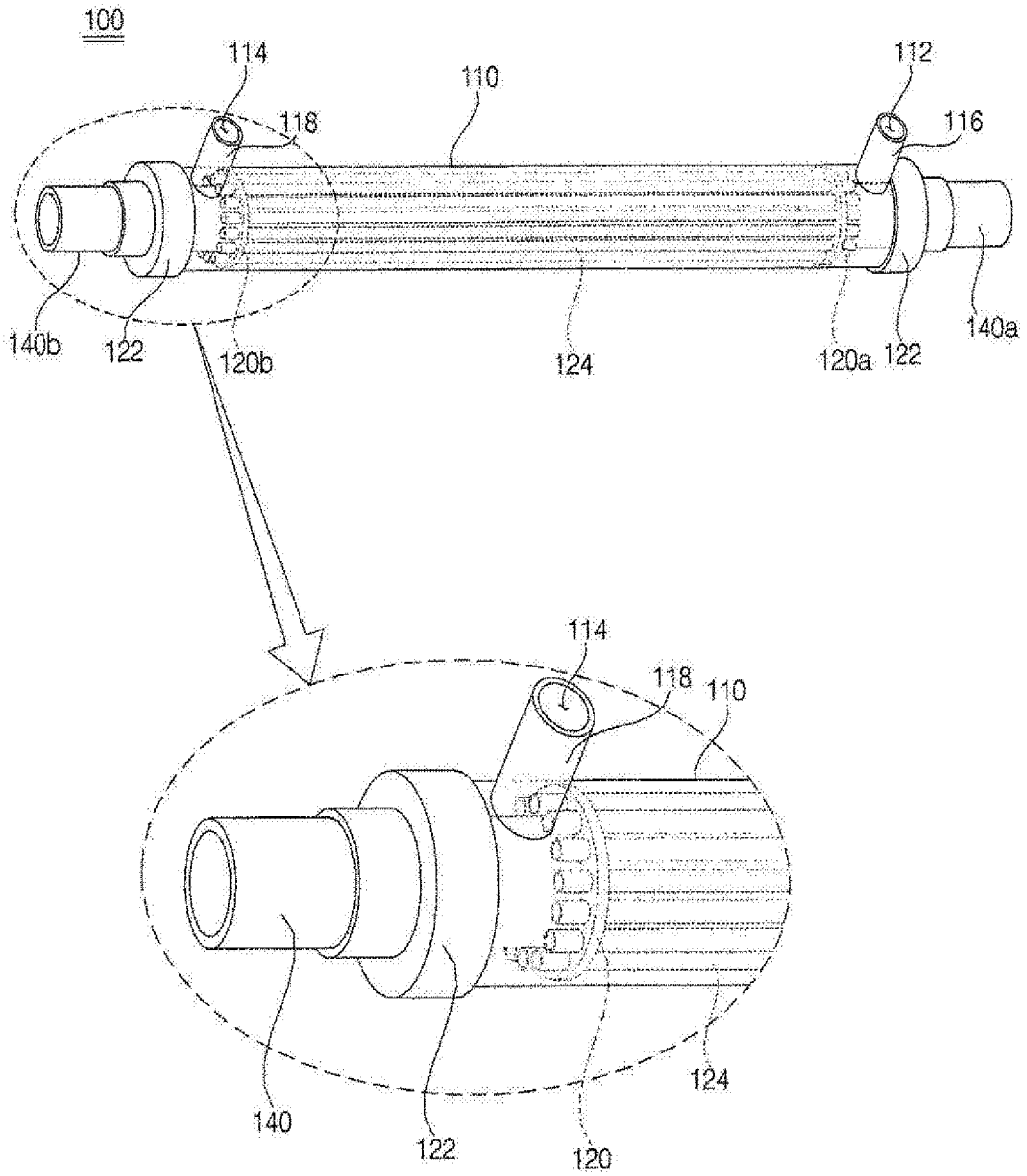
FIG. 9 is a perspective view and a partially enlarged view of a heat exchanger according to an embodiment of the present invention.
Figure 10:
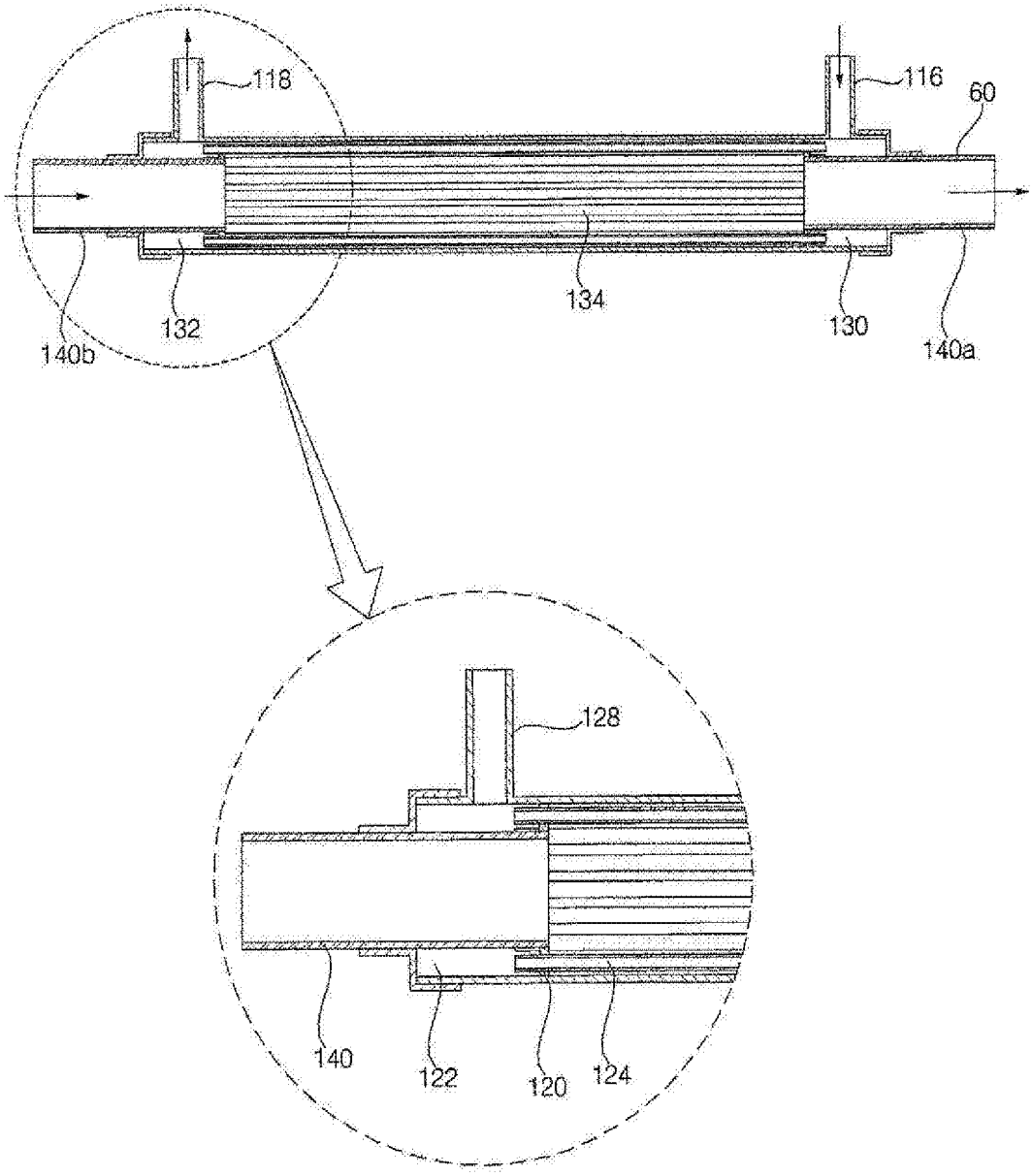
FIG. 10 is a cross-sectional view and a partially enlarged view of a heat exchanger according to an embodiment of the present invention.
Figure 11:
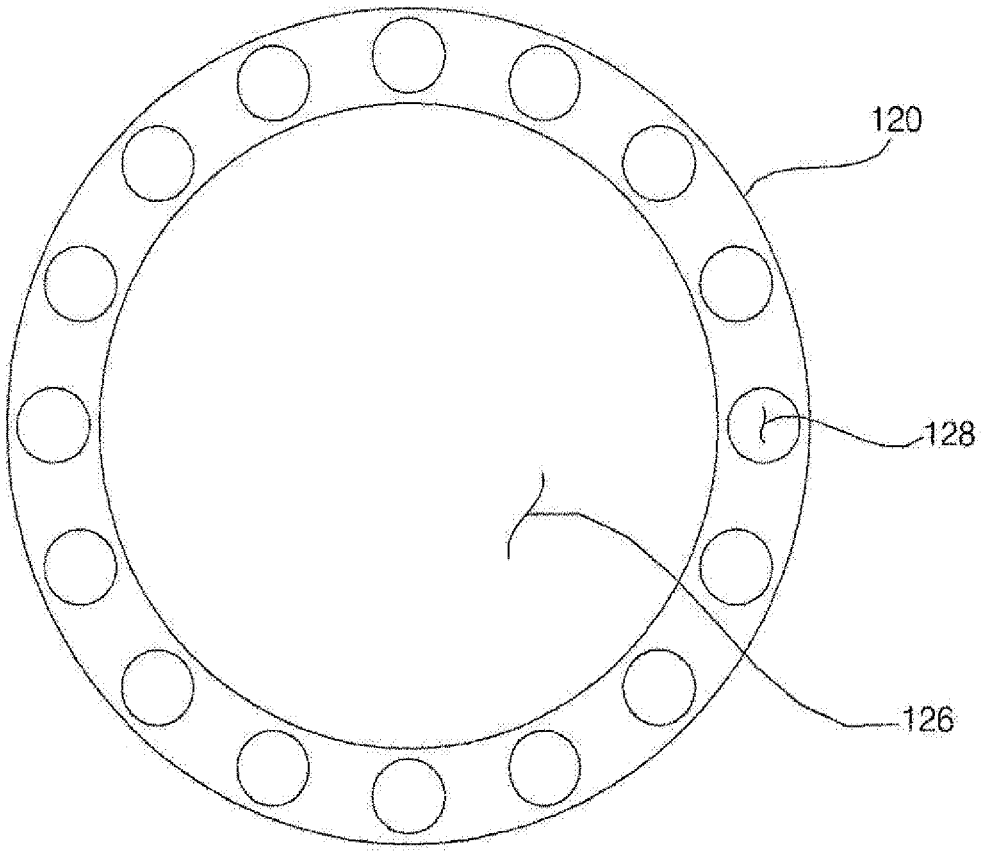
FIG. 11 is a diagram illustrating the front of an inner fixing plate according to an embodiment of the present invention.

FIG. 9 is a perspective view and a partially enlarged view of a heat exchanger according to an embodiment of the present invention. FIG. 10 is a cross-sectional view and a partially enlarged view of a heat exchanger according to an embodiment of the present invention. FIG. 11 is a diagram illustrating the front of an inner fixing plate according to an embodiment of the present invention.

The heat exchanger 100 according to the present embodiment has a structure in which two types of fluids exchange heat. The heat exchanger 100 installed inside the showcase I according to the present embodiment may allow heat exchange between a liquid refrigerant flowing through the liquid pipe 50 and a gaseous phase refrigerant flowing through the gas pipe 60. Specifically, in the heat exchanger 100 according to the present embodiment, a high temperature liquid refrigerant passed through the condenser 20 and a low temperature gaseous phase refrigerant passed through the evaporator exchange heat. The heat exchange between the low temperature refrigerant of the gas pipe and the high temperature refrigerant of the liquid pipe increases the supercooling degree of the liquid pipe.

The heat exchanger 100 according to the present embodiment includes an outer pipe 110 which has an inflow hole 112 through which a second fluid is introduced, a discharge hole 114 through which the second fluid is discharged, and an internal space in which the first fluid and the second fluid exchange heat; a first fluid pipe 140 which partly disposed inside the outer pipe and through which the first fluid flows; a plurality of narrow pipes 124 which are disposed inside the outer pipe and allow the second fluid introduced into the inflow hole of the outer pipe to flow; and an inner fixing plate 120 that partitions a space in which the first fluid pipe 140 and the plurality of narrow pipes are disposed. The first fluid pipe 140 and the plurality of narrow pipes 124 fixed to the inner fixing plate 120 are opened in different directions.

The outer pipe 110 has a substantially cylindrical shape. The outer pipe according to the present embodiment has a shape having both ends that are opened. The first fluid pipe 140 is inserted into the outer pipe through both opened ends of the outer pipe. The first fluid pipe 140 through which the first fluid flows is inserted into both ends of the outer pipe, and a part of the first fluid pipe 140 is disposed inside the outer pipe. The heat exchanger 100 according to the present embodiment includes an end fixing plate 122, which is provided in both ends of the outer pipe, that seals between the first fluid pipe 140 and the outer pipe 110. The end fixing plate 122 fixes the first fluid pipe disposed inside the outer pipe 110. The end fixing plate 122 has a hole, provided in the center thereof, through which the first fluid pipe 140 penetrates, and the first fluid pipe is fixed to the hole. The first fluid pipe 140 is fixed inside the outer pipe 110 by the end fixing plate 122 and the inner fixing plate 120.

The outer pipe 110 has an inflow nozzle 116, which is formed in one side of the circumferential surface, that is connected to a second fluid pipe (not shown), and a discharge nozzle 118, which is formed in the other side of the circumferential surface, that is connected to the second fluid pipe. The inflow nozzle 116 has an inflow hole 112 and receives a second fluid flowing through the second fluid pipe, and the discharge nozzle 118 has a discharge hole 114 to discharge the second fluid to the second fluid pipe.

In the heat exchanger according to the present embodiment, the first fluid pipe 140 has a structure that is not bent when connected to the outer pipe 110. The first fluid pipe 140 maintains a straight pipe shape when connected to the outer pipe. The second fluid pipe may be bent in the process of being connected to the inflow nozzle 116 or the discharge nozzle 118 or may be connected to a banding pipe.

The plurality of narrow pipes 124 according to the present embodiment are disposed in a space different from the first fluid pipe 140 inside the outer pipe 110. The plurality of narrow pipes 124 are fixed inside the outer pipe by two inner fixing plates 120 disposed inside the outer pipe 110. The plurality of narrow pipes 124 are fixed by two inner fixing plates 120 disposed in both ends. The plurality of narrow pipes 124 according to the present embodiment are disposed in the inner fixing plate around the first fluid pipe 140 fixed to the inner fixing plate 120. The second fluid introduced into the inflow hole flows through the plurality of narrow pipes 124.

The inner fixing plate 120 is a circular plate and has a central hole 126, into which the first fluid pipe 140 is inserted, that is formed in the center, and a plurality of narrow pipe holes 128 into which the plurality of narrow pipes 124 are inserted, that are formed around the central hole. The outer circumference of the inner fixing plate 120 is fixed to the inner circumference of the outer pipe 110. In the inner fixing plate 120, the first fluid pipe 140 is connected to the central hole 126, and the plurality of narrow pipes 124 are connected to the plurality of narrow pipe holes 128. The first fluid pipe 140 and the plurality of narrow pipes 124 are opened in different directions.

The inner fixing plate 120 partitions a portion that exchanges heat with the first fluid pipe 140 and a portion that exchanges heat with the plurality of narrow pipes 124. The inner fixing plate 120 partitions an area in which the second fluid flows into the outer pipe 110 or an area in which the second fluid is discharged from the outer pipe 110 and a portion that exchanges heat with the plurality of narrow pipes.

The heat exchanger 100 according to the present embodiment divides the outer pipe into three zones, and heats the three zones in different ways.

The heat exchanger 100 according to the present embodiment includes the outer pipe 110, a first sub heat exchange part 130 and a second sub heat exchange part 132, which are disposed inside the outer pipe 110, that have a second fluid flowing around the first fluid pipe 140 through which the first fluid flows, and a main heat exchange part 134 which is disposed between the first sub heat exchange part 130 and the second sub heat exchange part 132 inside the outer pipe 110, and has the first fluid flows around the plurality of narrow pipes 124 through which the second fluid flows.

The first sub heat exchange part 130 and the main heat exchange part 134 are partitioned by a first inner fixing plate 120*a*. The main heat exchange part 134 and the second sub heat exchange part 132 are partitioned by a second inner fixing plate 120*b*.

In the heat exchanger according to the present embodiment, the first fluid flows in the order of the second sub heat exchange part 132, the main heat exchange part 134, and the first sub heat exchange part 130, and the second fluid flows in the order of the first sub heat exchange part 130, the main heat exchange part 134, and the second sub heat exchange part 132. However, this is just an embodiment, and the first fluid and the second fluid can flow in the same direction.

In the first sub heat exchange part 130, the second fluid is introduced into the inflow hole 112 formed in one side of the outer pipe. The first sub heat exchange part 130 has a first fluid pipe 140 disposed inside the outer pipe. In the first sub heat exchange part 130, the second fluid introduced into the inflow hole 112 flows around the first fluid pipe 140. In the first sub heat exchange part 130, the first fluid passed through the main heat exchange part 134 is introduced into and flows the first fluid pipe 140. The second fluid flowing in the first sub heat exchange part 130 flows into the plurality of narrow pipes 124.

The main heat exchange part 134 has a plurality of narrow pipes 124 disposed inside the outer pipe 110. The plurality of narrow pipes 124 are fixed to the first inner fixing plate 120*a* and the second inner fixing plate 120*b*. One end of the plurality of narrow pipes 124 is opened toward the first sub heat exchange part 130, and the other end thereof is opened toward the second sub heat exchange part 132. The second fluid flows along the plurality of narrow pipes 124 inside the main heat exchange part 134. In the main heat exchange part 134, the first fluid flows around the plurality of narrow pipes 124. Both ends of the main heat exchange part 134 are connected with the first fluid pipe 140 into which the first fluid is introduced and the first fluid pipe 140 through which the first fluid is discharged. Each of the first fluid pipes 140 into which the first fluid is introduced or through which the first fluid is discharged is fixed to each of the first or second inner fixing plate 120*b* and is opened toward the main heat exchange part 134. The first fluid discharged from the first fluid pipe 140 to the main heat exchange part 134 flows around the plurality of narrow pipes 124 disposed therein.

The second fluid flowing through the plurality of narrow pipes 124 is introduced to the second sub heat exchange part 132. The plurality of narrow pipes 124 are fixed to the second inner fixing plate 120*b* and opened in the direction of the second sub heat exchange part 132. The second sub heat exchange part 132 has the first fluid pipe 140 disposed inside the outer pipe 110. In the second sub heat exchange part 132, the second fluid introduced from the main heat exchange part 134 flows around the first fluid pipe 140. The first fluid flowing through the first fluid pipe 140 disposed in the second sub heat exchange part 132 flows to the main heat exchange part 134. The second fluid flowing in the second sub heat exchange part 132 flows to the discharge hole 114 formed in one side of the outer pipe.

In the heat exchanger 100 according to the present embodiment, the first fluid may be a gaseous phase refrigerant discharged from the evaporator, and the second fluid may be a liquid refrigerant discharged from the condenser. In this case, the first fluid pipe 140 is a gas pipe through which the gaseous phase refrigerant flows, and the second fluid pipe may be a liquid pipe through which the liquid refrigerant flows.

The heat exchanger 100 according to the present embodiment may form a straight pipe shape in which the gas pipe 60 is not bent. On the other hand, the liquid pipe 50 of the heat exchanger 100 has a bent shape during the process of being connected to the inflow nozzle 116 and the discharge nozzle 118. The heat exchanger 100 according to the present embodiment may minimize the pressure loss of the gaseous phase refrigerant generated by changing the flow path of the gas pipe as the gas pipe 60 has a straight pipe shape and is not bent.

In the heat exchanger 100 according to the present embodiment, heat exchange between the first fluid and the second fluid occurs mainly in the main heat exchange part 134. Therefore, if the heat exchange amount in the main heat exchange part 134 is increased, the total amount of heat exchange of the heat exchanger is also increased.

The amount of heat exchange may increase according to the speed of the second fluid flowing through the plurality of narrow pipes 124. The speed of the second fluid flowing through the plurality of narrow pipes 124 may vary depending on the ratio of the area according to the inner diameter of the second fluid pipe and the total area according to the inner diameter of the plurality of narrow pipes 124. In the heat exchanger according to the present embodiment, the amount of heat exchange may be increased according to the ratio of the cross-sectional area according to the inner diameter of the second fluid pipe into which the second fluid is introduced and the total cross-sectional area according to the inner diameter of the plurality of narrow pipes 124.

In the heat exchanger 100 according to the present embodiment, it is preferable that the ratio Y/X of the cross-sectional area X due to the inner diameter of the second fluid pipe and the total cross-sectional area Y according to the inner diameter of the plurality of narrow pipes is 0.05 to 0.4.

TABLE 1

| Case | 1 | 2 | 3 | 4 | 5 | 6 | 7 | 8 | 9 | 10 | 11 | 12 | 13 | 14 |
|---|---|---|---|---|---|---|---|---|---|---|---|---|---|---|
| Gas pipe diameter mm | 23 | 23 | 23 | 23 | 19.8 | 20.4 | 20.4 | 20.4 | 20.4 | 17.3 | 16.7 | 16.7 | 16.7 | 16.7 |
| Liquid pipe diameter mm | 8.1 | 8.1 | 8.1 | 8.1 | 8.1 | 8.1 | 8.1 | 8.1 | 8.1 | 8.1 | 8.1 | 8.1 | 8.1 | 8.1 |
| Narrow pipe diameter mm | 1.6 | 1.6 | 1.2 | 1.2 | 1.2 | 1.2 | 1.2 | 1.2 | 1.2 | 1.2 | 1.2 | 1.2 | 1.2 | 1.2 |
| Number of narrow pipe | 14 | 16 | 14 | 16 | 16 | 16 | 15 | 14 | 13 | 16 | 15 | 14 | 13 | 12 |
| Heat recovery amount W | 206 | 209 | 228 | 242 | 287 | 279 | 277 | 268 | 257 | 321 | 312 | 303 | 293 | 281 |
| Heat recovery amount (%) | 100 | 101 | 111 | 117 | 139 | 135 | 134 | 130 | 124 | 156 | 151 | 147 | 142 | 136 |
| Area ratio | 0.54 | 0.62 | 0.31 | 0.35 | 0.35 | 0.35 | 0.33 | 0.31 | 0.28 | 0.35 | 0.33 | 0.31 | 0.28 | 0.26 |

TABLE 2

| Case | 1 | 2 | 3 | 4 | 5 |
|---|---|---|---|---|---|
| Gas pipe diameter mm | 23 | 13.9 | 13.9 | 13.9 | 23 |
| Liquid pipe diameter mm | 8.1 | 8.1 | 8.1 | 8.1 | 8.1 |
| Narrow pipe diameter mm | 3.36 | 0.8 | 0.8 | 0.8 | 1.2 |
| Number of narrow pipe | 5 | 16 | 15 | 14 | 8 |
| Heat recovery amount W | 94.5 | 154.4 | 151.4 | 148.0 | 145 |
| Heat recovery amount (%) | 100 | 163 | 160 | 157 | 154 |
| Area ratio | 0.86 | 0.16 | 0.15 | 0.14 | 0.06 |

Referring to Table 1, in a refrigeration system having a refrigerant flow rate of 31 kg/h, when the ratio of the area according to the inner diameter of the second fluid pipe and the total area according to the inner diameter of the plurality of narrow pipes becomes 0.05 to 0.4, it can be seen that the heat recovery amount is increased by 10% or more in comparison with a case where the area ratio is 0.5 or more. In addition, referring to Table 2, in the refrigeration system having a refrigerant flow rate of 15.5 kg/h, when the ratio of the area according to the inner diameter of the second fluid pipe and the total area according to the inner diameter of the plurality of narrow pipes becomes 0.05 to 0.4, it can be seen that the heat recovery amount is increased by 50% or more in comparison with a case where the area ratio is 0.5 or more.

Although the exemplary embodiments of the present invention have been disclosed for illustrative purposes, those skilled in the art will appreciate that various modifications, additions and substitutions are possible, without departing from the scope and spirit of the invention as disclosed in the accompanying claims. Accordingly, the scope of the present invention is not construed as being limited to the described embodiments but is defined by the appended claims as well as equivalents thereto.

The invention claimed is:

1. A heat exchanger comprising:

an outer pipe;

a first sub heat exchange part and a second sub heat exchange part which are disposed inside the outer pipe, and in which a second fluid flows around a first fluid pipe through which a first fluid flows; and a main heat exchange part which is disposed, inside the outer pipe, between the first sub heat exchange part and the second sub heat exchange part, and in which the first fluid flows around a plurality of narrow pipes through which the second fluid flows.

2. The heat exchanger of claim 1, further comprising:

a first inner fixing plate partitioning the first sub heat exchange part and the main heat exchange part; and a second inner fixing plate partitioning the main heat exchange part and the second sub heat exchange part.

3. The heat exchanger of claim 2, wherein the first inner fixing plate and the second inner fixing plate fix the plurality of narrow pipes, and the plurality of narrow pipes have one end that is opened toward the first sub heat exchange part, and the other end that is opened toward the second sub heat exchange part.

4. The heat exchanger of claim 2, wherein the first inner fixing plate fixes the first fluid pipe disposed in the first sub heat exchange part, the second inner fixing plate fixes the first fluid pipe disposed in the second sub heat exchange part, and each of the first fluid pipe fixed to the first inner fixing plate and a second fluid pipe fixed to the second inner fixing plate is opened toward the main heat exchange part.

5. The heat exchanger of claim 1, wherein, in the first sub heat exchange part, the first fluid passed through the main heat exchange part flows to the first fluid pipe disposed in the first sub heat exchange part, and the second fluid introduced into an inflow hole formed in one side of the outer pipe flows around the first fluid pipe.

6. The heat exchanger of claim 1, further comprising a first inner fixing plate partitioning the first sub heat exchange part and the main heat exchange part, wherein the first inner fixing plate fixes the plurality of narrow pipes into which the second fluid flowing in the first sub heat exchange part flows, and the first fluid pipe into which the first fluid flowing in the main heat exchange part flows.

7. The heat exchanger of claim 1, further comprising a second inner fixing plate partitioning the main heat exchange part and the second sub heat exchange part, wherein the second inner fixing plate fixes the plurality of narrow pipes which are disposed in the main heat exchange part and discharge the second fluid to the second sub heat exchange part, and the first fluid pipe which is disposed in the second sub heat exchange part and discharges the first fluid to the main heat exchange part.

* * * * *